US006470866B2

(12) United States Patent
Cook

(10) Patent No.: US 6,470,866 B2
(45) Date of Patent: Oct. 29, 2002

(54) DIESEL ENGINE EXHAUST GAS RECIRCULATION (EGR) SYSTEM AND METHOD

(75) Inventor: John Edward Cook, Chatham (CA)

(73) Assignee: Siemens Canada Limited, Mississauga (CA)

( * ) Notice: Subject to any disclaimer, the term of this patent is extended or adjusted under 35 U.S.C. 154(b) by 1 day.

(21) Appl. No.: 09/739,060

(22) Filed: Dec. 18, 2000

(65) Prior Publication Data

US 2001/0029935 A1 Oct. 18, 2001

Related U.S. Application Data

(60) Provisional application No. 60/174,532, filed on Jan. 5, 2000.

(51) Int. Cl.[7] ..... F02M 25/07
(52) U.S. Cl. ..... 123/568.27; 60/605.2
(58) Field of Search ..... 123/568.27, 568.123; 60/605.2

(56) References Cited

U.S. PATENT DOCUMENTS 4,386,597 A * 6/1983 Ootaka et al. ..... 123/568.27
5,257,610 A * 11/1993 Ohuchi ..... 123/568.16
5,379,744 A * 1/1995 Pischke et al. ..... 123/568.27
5,507,262 A * 4/1996 Isobe et al. ..... 123/568.27
5,613,479 A * 3/1997 Gates et al. ..... 123/568.27
5,937,650 A 8/1999 Arnold ..... 60/605.2
5,988,149 A * 11/1999 Gates ..... 123/568.27
6,035,639 A * 3/2000 Kolmanovsky et al. .... 60/605.2
6,128,902 A * 10/2000 Kolmanovsky et al. .... 60/605.2
6,170,426 B1 * 1/2001 Cook et al. ..... 123/568.27

FOREIGN PATENT DOCUMENTS

| | | |
|---|---|---|
| DE | 32 37 337 A1 | 10/1982 |
| EP | 0 531 277 A2 | 8/1992 |
| EP | 06065995 | 4/1994 |
| EP | 07336085 | 11/1995 |
| JP | 7-279777 | 10/1995 |
| JP | 9-151805 | 10/1997 |

* cited by examiner

*Primary Examiner*—Paul J. Hirsch

(57) ABSTRACT

Apparatus for and method of exhaust gas recirculation in an internal combustion engine that operates with charge air boost. An EGR valve has an inlet port communicated to the engine exhaust system upstream of a throttle valve in the tailpipe and an outlet port communicated to the engine intake system. The throttle valve is controlled to selectively restrict exhaust gas flow through the tailpipe so as to maintain the difference between pressure at the EGR valve inlet and pressure at the EGR valve outlet substantially unaffected by changes in pressure in the intake system and in the exhaust system. The invention is particularly suited for a turbocharged diesel engine.

11 Claims, 2 Drawing Sheets

DIESEL ENGINE EXHAUST GAS RECIRCULATION (EGR) SYSTEM AND METHOD

REFERENCE TO RELATED APPLICATION AND PRIORITY CLAIM

This application derives from the following commonly owned co-pending patent application, the priority benefit of which is expressly claimed: Provisional Application Ser. No. 60/174,532 filed on Jan. 5, 2000 in the name of John Edward Cook and entitled DIESEL EGR SYSTEM.

FIELD OF THE INVENTION

This invention relates to exhaust gas recirculation (EGR) in internal combustion engines, particularly in turbocharged diesel engines.

BACKGROUND AND SUMMARY OF THE INVENTION

Controlled engine exhaust gas recirculation is a known technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the intake flow entering the engine so as to limit the combustion temperature within the engine and hence reduce the formation of oxides of nitrogen. The EGR rate is controlled by controlling the extent of EGR valve opening and the pressure differential across the EGR valve.

Supercharging an engine is one method for improving the performance of a motor vehicle. Supercharging an engine by an exhaust-driven turbine is known as turbocharging. A turbocharger comprises a compressor that boosts intake system pressure and a turbine that is powered by engine exhaust to operate the compressor.

It is believed that turbocharged engines may provide improvements for enabling vehicle manufacturers to achieve both mandated fuel economy requirements and a desired level of engine performance. However, because such engines must also comply with mandated tailpipe emission requirements, it appears that they will still need EGR systems.

When an engine is running supercharged, intake system pressure can exceed exhaust system pressure. Exhaust system pressure that is lower than intake system pressure creates across an EGR valve a pressure differential that is opposite that required for exhaust gas recirculation. Consequently, there is need for a solution that will allow exhaust gas to be recirculated.

It is toward such a solution that the present invention is directed, especially a solution for enabling an engine that has a supercharger, particularly one that has an exhaust gas driven turbocharger, to comply with diverse requirements for fuel economy, tailpipe emissions and engine performance.

Accordingly, the present invention relates to a new and unique EGR system and method for a supercharged engine, particularly a turbocharged diesel engine.

A general aspect of the invention relates to an internal combustion engine that operates with charge air boost and comprises an intake system, an exhaust system comprising a tailpipe, a throttle valve for selectively restricting exhaust gas flow to the tailpipe, and an exhaust gas recirculation (EGR) system for controlled recirculation of exhaust gas from the exhaust system to the intake system comprising an EGR valve having an inlet port communicated to the exhaust system upstream of the throttle valve and an outlet port communicated to the intake system. A control for operating the EGR valve and the throttle valve includes a regulator for operating the throttle valve to partially restrict exhaust gas flow to the tailpipe to regulate the difference between pressure at the EGR valve inlet and pressure at the EGR valve outlet to a desired differential that is substantially unaffected by pressure change in the intake system and in the exhaust system.

Another general aspect relates to a method of exhaust gas recirculation in an internal combustion engine that operates with charge air boost and comprises an intake system, an exhaust system comprising a tailpipe, a throttle valve for selectively restricting exhaust gas flow to the tailpipe, and an exhaust gas recirculation (EGR) system for controlled recirculation of exhaust gas from the exhaust system to the intake system comprising an EGR valve having an inlet port communicated to the exhaust system upstream of the throttle valve and an outlet port communicated to the intake system. The method comprises controlling the EGR valve and the throttle valve, including operating the throttle valve to partially restrict exhaust flow to the tailpipe in a manner that regulates the difference between pressure at the EGR valve inlet and pressure at the EGR valve outlet to a desired differential that is substantially unaffected by pressure change in the intake system and in the exhaust system.

Another aspect relates to a pneumatic regulator for association with an internal combustion engine that has an intake system, an exhaust system including a tailpipe, a throttle valve for selectively restricting exhaust gas low to the tailpipe, and an exhaust gas recirculation (EGR) system for controlled recirculation of exhaust gas from the exhaust system to the intake system including an EGR valve having an inlet port communicated to the exhaust system upstream of the throttle valve and an outlet port communicated to the intake system. The regulator comprises a body comprising pressure differential sensing ports for sensing pressure differential across the inlet and outlet ports of the EGR valve, and a pneumatic pressure regulating mechanism that is associated with a source port adapted to be communicated to a pneumatic power source, with a vent port adapted to be communicated to atmosphere, and with a regulated pressure port, and that operates to develop at the regulated pressure port a regulated pneumatic pressure for operating the throttle valve.

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
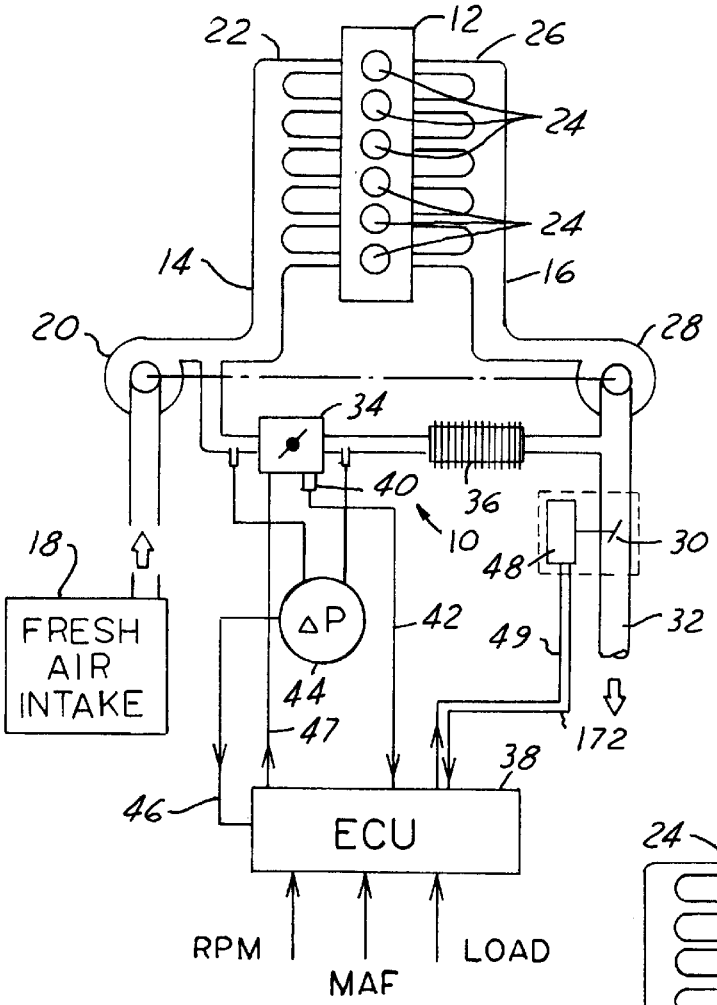
FIG. 1 is a schematic diagram of an engine comprising a first embodiment of EGR system according to principles of the invention.

FIG. 1 illustrates a first embodiment of the inventive EGR system 10 in association with an internal combustion engine 12. Engine 12 is one example of a supercharged engine, a turbocharged diesel engine in this instance. Only those portions of engine 12 associated with EGR system 10 will be discussed here in the interest of brevity because description of other portions is unnecessary to an understanding of principles of the present invention.

Engine 12 comprises an intake system 14 and an exhaust system 16. Intake system 14 comprises a fresh air intake 18, a compressor 20, and an intake manifold 22, in that order, along the direction of intake flow to engine combustion chambers 24. Exhaust system 16 comprises an exhaust manifold 26, a turbine 28, a throttle valve 30, and a tailpipe 32, in that order, along the direction of exhaust flow from combustion chambers 24.

EGR system 10 comprises an EGR valve 34 through which exhaust gas is recirculated from exhaust system 16 to intake system 14. Exhaust gas for recirculation is obtained from exhaust system 16 at the outlet of turbine 28. Before entering EGR valve 34, exhaust gas is cooled by an EGR cooler 36. After exiting EGR valve 34, exhaust gas is introduced into intake system 14 ahead of intake manifold 22, but after compressor 20. Collectively, turbine 28 and compressor 20 constitute a turbocharger.

A controller, such an engine electronic control unit (ECU) 38, exercises control over various aspects of engine operation, including control over exhaust gas recirculation according to a control strategy appropriate to the particular engine. The control strategy is based on certain variable parameters, some of which are shown in FIG. 1 as engine speed (rpm), engine load, and mass airflow into the engine (MAF). The control strategy comprises control of both throttle valve 30 and EGR valve 34.

An associated position sensor 40 provides to ECU 38 a position feedback signal 42 representing the extent to which the valve is selectively restricting EGR flow. An associated differential pressure sensor 44 reads the difference between the pressure at the EGR valve inlet and that at the EGR valve outlet. Sensor 44 supplies a signal 46 representing that difference to ECU 38. Alternatively a signal representing pressure at the valve inlet and one representing pressure at the valve outlet can be transmitted to ECU 38 for ECU 38 to compute the pressure differential.

Position feedback from position sensor 40 is used in closed loop control of EGR valve 34 to control the extent to which the EGR valve is opened. Because position feedback signal 42 furnishes ECU 38 data that represents the degree of restriction to EGR flow presented by EGR valve 34, and because signal 46 furnishes ECU 38 data that represents the differential pressure across the restriction, the EGR flow rate through EGR valve 34 can be approximated by a calculation performed by ECU 38 on that data.

EGR valve 34 further comprises an electric actuator, a linear solenoid for example, that opens the valve to an extent commanded by a command signal 47 from ECU 38 acting on the actuator via a driver circuit. Throttle valve 30 too comprises an electric actuator 48 that selectively restricts flow through the valve to an extent commanded by a command signal 49 from ECU 38. The throttle valve actuator may be an electric D.C. motor.

The basic control strategy provided by the invention comprises operating throttle valve 30 to throttle the exhaust flow to tailpipe 32 to an extent sufficient to develop pressure at the inlet of EGR valve 34 that, when compressor 20 is providing boost to the charge air to combustion chambers 24, will regulate the pressure across the EGR valve to a desired differential that will allow the extent to which the EGR valve is open to establish a corresponding predetermined EGR rate. As engine operation, and/or turbocharger operation, and/or the EGR rate requirement changes, valve 30, valve 34, or both of them, may be adjusted in response to change in one or both command signals 47, 49. An adjustment of one valve may necessitate an adjustment of the other in order to accomplish a desired result, and hence coordinated control of both valves is believed to be a desirable basic control strategy.

EGR rate is controlled by ECU 38 processing appropriate input parameter data with the feedback data from position sensor 40 and the feedback data from differential pressure sensor 44 to develop a value for command signal 47 that sets the extent of opening of EGR valve 34 to achieve the desired EGR rate for prevailing pressure conditions in intake and exhaust systems 14, 16. ECU 38 processes appropriate data to develop a value for command signal 49 that operates throttle valve 30 so as to regulate the pressure difference across EGR valve 34 to a desired pressure difference. Favored operation of throttle valve 30 will seek the lowest restriction of exhaust gas flow to tailpipe 32 consistent with the objective of achieving the desired regulation of pressure differential across EGR valve 34.

Figure 2:
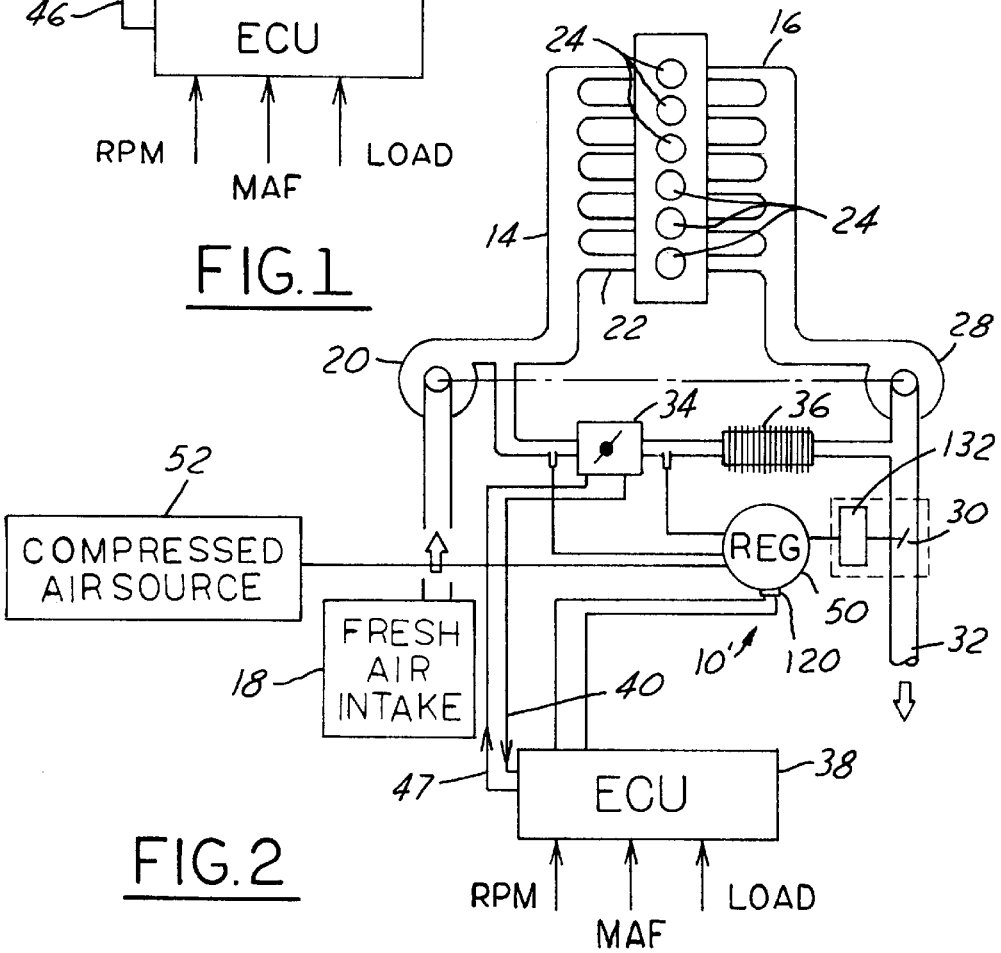
FIG. 2 is a schematic diagram of an engine comprising a second embodiment of EGR system according to principles of the invention.

FIG. 2 illustrates a second embodiment of inventive EGR system 10' in association with an engine 12. The same parts that are present in both FIGS. 1 and 2 are marked by the same reference numerals in both Figs. and so a detailed description of them will not be repeated. System 10' differs from system 10 in that throttle valve 30 is controlled by a pneumatic valve regulator 50 instead of an electric motor. The difference between the pressure at the inlet of EGR valve 34 and that at the EGR valve outlet, i.e. the pressure differential across the valve, serves as an input to regulator 50 rather than an input to a differential pressure sensor that converts the difference to an electric signal for subsequent processing and use by ECU 38 as in system 10 of FIG. 1. Pneumatic power for operating throttle valve 30 is obtained from a pneumatic power source, such as a compressed air source 52 communicated through a conduit to regulator 50. Large vehicles such as heavy trucks commonly have an available compressed air source. An example of such a regulator 50 appears by itself in FIG. 3 while an example of an associated throttle valve 30 appears by itself in FIG. 6.

Regulator 50 is a device that comprises a body 54 having multiple ports shown as nipples protruding from body 54. Each nipple is open to a respective chamber space internal to body 54. A first port 56 serves to communicate pressure at the inlet of EGR valve 34 (i.e. pressure at the exhaust system side of the valve) to a first internal chamber space 58. A second port 60 serves to communicate pressure at the outlet of EGR valve 34 (i.e. pressure at the intake system side of the valve) to a second internal chamber space 62. A movable wall 64 separates chamber spaces 58, 62 from each other. A third port 66 conveys pressurized air from compressed air source 52 to a third internal chamber space 68. A fourth port 70 is in communication with a fourth internal chamber space 72, and a fifth port 74 is in communication with a fifth internal chamber space 76.

Chamber spaces 58, 62, 72, and 76 are arranged in succession along an imaginary centerline 78. A cylindrical stem 80 is disposed concentric with, and guided on body 54 for linear motion along, centerline 78. Body 54 comprises an internal partition 82 that is transverse to centerline 78. Chamber space 62 is disposed to one side of partition 82 while chamber spaces 68 and 72 are disposed to the other side.

Partition 82 comprises a hub 84 concentric with centerline 78. A through-bore 86 passes through hub 84 concentric with centerline 78. Stem 80 passes completely through through-bore 86. Proximate one axial end of hub 84, a gas-tight seal 88 seals between the outside diameter (O.D.) of stem 80 and the wall of through-bore 86. Proximate the other axial end of hub 84, a gas-tight seal 90 seals between the outside diameter (O.D.) of stem 80 and the wall of through-bore 86. An example of a suitable material for seals 88, 90 is graphite-impregnated packing material that is slightly compressible.

Figure 4:
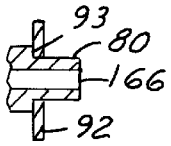
FIG. 4 is an enlarged view of another portion of FIG. 3.

A spring seat 92 is fit over and secured to the O.D. of stem 80 within chamber space 72. FIG. 4 shows greater detail, particular a shoulder 93 of stem 80 against which spring seat 92 is located. A helical coil compression spring 94 is held compressed between spring seat 92 and a shoulder at one end of chamber space 72 to urge stem 80 in a direction along centerline 78 that is toward chamber space 62. This serves to force the tip end of stem 80 that is within chamber space 62 against the center of a rigid disk 95 that forms a gas-impermeable center part of movable wall 64.

Movable wall 64 further comprises a gas-impermeable outer annular part 96 having an inner margin secured gas-tight to the outer margin of disk 95 and an outer margin held sealed to a wall of body 54 that circumferentially bounds chamber spaces 58, 62 at a joint between two mating parts of body 54. Part 96 is constructed to provide for disk 95 to move freely back and forth along centerline 78. A helical coil compression spring 98 disposed within chamber space 58 acts to urge disk 95 in a direction along centerline 78 toward chamber space 62. One end of spring 98 is centered to centerline 78 via a central spring seat formation in disk 95. The opposite end of spring 98 is centered to a spring seat 100 that is positionable within chamber space 58 axially along centerline 78 via an adjusting mechanism 102.

Adjusting mechanism 102 comprises a threaded adjuster 104 that is threaded with a threaded hole 106 in body 54 concentric with centerline 78 at an end wall of body 54 bounding chamber space 58 opposite movable wall 64. An external end of adjuster 104 can be turned by an adjustment tool (not shown) to set the position of spring seat 100 along centerline 78.

Partition 82 comprises a passage 108 that communicates chamber space 68 with that portion of through-bore 86 that lies between seals 88 and 90. Passage 108 extends perpendicularly away from through-bore 86 and then makes a right angle bend to terminate in a circumscribing valve seat 110 at chamber space 68. A valve element 112 is disposed at one end of an armature 114 that is resiliently biased by a spring 116 to seat valve element 112 on seat 110 and close passage 108 to chamber space 68. Unseating of valve element 112 is accomplished by energizing a solenoid coil 118 to pull armature 114 and valve element 112 away from seat 110 against the force of spring 116. With valve element 112 unseated, air can flow from chamber space 68 into passage 108 and thence through-bore 86. An electric connector 120 provides for solenoid coil 118 to be connected to a driver circuit (not shown) under the control of ECU 38 for operating the solenoid to open and close passage 108.

Figure 3:
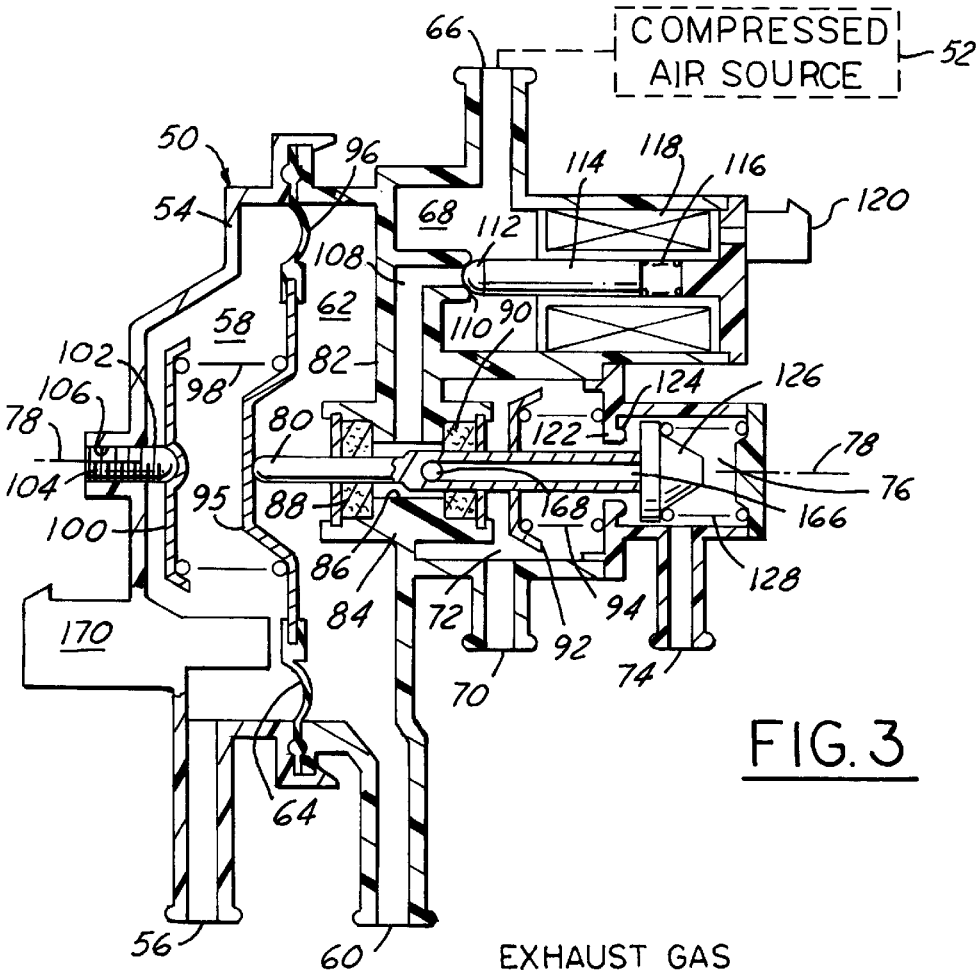
FIG. 3 is a cross section view through an exemplary embodiment of one device present in the EGR system of FIG. 2.

Body 54 comprises a shoulder 122 that separates chamber spaces 72 and 76 from each other. The inner margin of shoulder 122 comprises a valve seat 124 facing chamber space 76. A valve element 126 is disposed within chamber space 76 and guided for motion along centerline 78. A helical coil compression spring 128 acts to urge valve element 126 in a direction along centerline 78 toward stem 80 and toward seating on seat 124 for closing chamber space 72 to chamber space 74. FIG. 3 shows the position assumed by valve element 126 and stem 80 when no EGR flow is being requested, and in that position valve element 126 has been unseated from seat 124 by stem 80 to cause chamber space 72 to be open to chamber space 74. From this, it can be appreciated that the arrangement of valve element 126 and spring 128 provides a vent valve proximate an end of centerline 78. It can also be appreciated that spring 98 is somewhat stiffer than spring 94.

Figure 5:
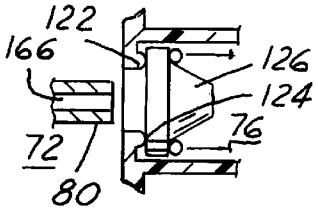
FIG. 5 is an enlarged view of a portion of FIG. 3 showing a different operating position for certain parts that are being illustrated.

Stem 80 comprises a blind hole 166 that is open at the axial end of the stem that is being forced against valve element 126 in FIG. 3. Hole 166 extends from that axial end to a depth where it intersects a radial hole 168 that extends to the O.D. of the stem where the radial hole 168 is open to an annular space that is bounded radially by the stem O.D. and the wall of through-bore 86 and axially by seals 88 and 90. The end of passage 108 at through-bore 86 is also open to that annular space. The force with which stem 80 is unseating valve element 126 closes the open end of hole 166. FIG. 5 will be explained later when the manner in which regulator 50 operates is described.

Figure 6:
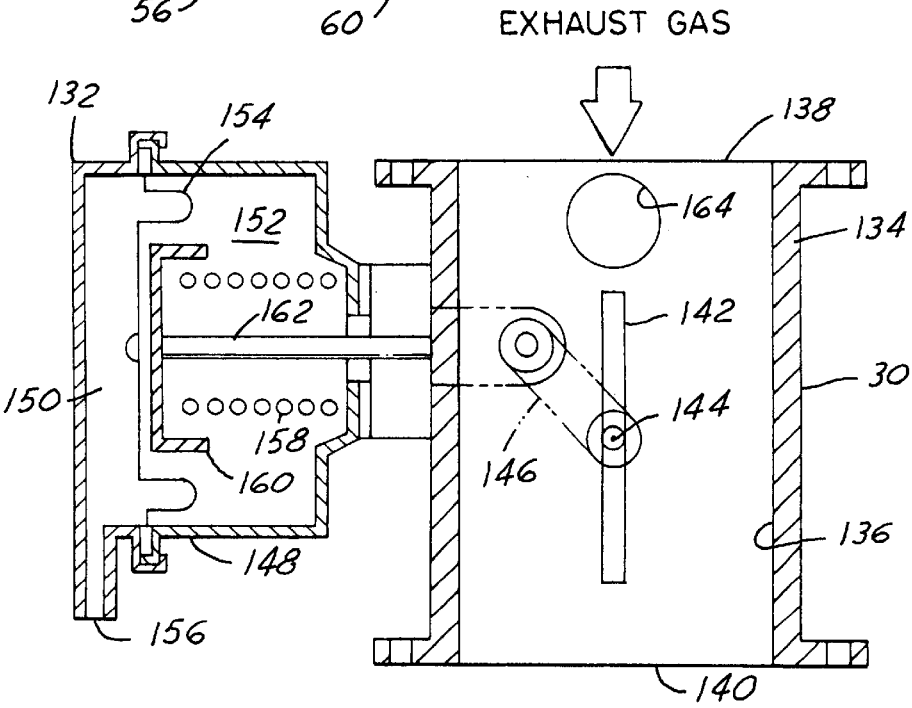
FIG. 6 is a cross section view through an exemplary embodiment of another device present in the EGR system of FIG. 2.

FIG. 6 shows detail of throttle valve 30. Operation of throttle valve 30 is accomplished by a pneumatic actuator 132 that is under the control of regulator 50. Valve 30 comprises a cylindrical body 134 providing a passage 136 of circular cross section. Passage 136 has an entrance 138 at one end and an exit 140 at the opposite end. Flanges, or ears, at the entrance and exit provide for body 134 to be connected into exhaust system 16 to convey exhaust gas to tailpipe 32.

A butterfly 142 is disposed within passage 136 on a shaft for turning about an axis 144 that is transverse to passage 136. A lever or crank 146 that is external to passage 136 turns butterfly 142 to any desired position within a range of angular positions about axis 144. The position shown in FIG. 6 shows butterfly 142 minimally restricting passage 136. As crank 146 turns butterfly 142 increasingly clockwise, passage 136 is increasingly restricted.

Actuator 132 comprises a body 148 that is divided into two chamber spaces 150, 152 by a movable wall 154. Chamber space 150 is communicated via a port 156 to port 70 of regulator 50. Chamber space 152 is vented to atmosphere. A helical coil compression spring 158 is disposed within chamber space 152 to urge movable wall 154 in a sense toward chamber space 150. One end of spring 158 seats in a spring seat 160 that is fastened to the center of movable wall 154. A shaft 162 extends from the center of spring seat 160 to the free end of crank 146.

FIG. 6 shows a condition where the pressures in chamber spaces 150, 152 are equal. As pressure in chamber space 150 increases relative to that in chamber space 152, movable wall 154 is increasingly displaced toward chamber space 152 against the force of spring 158, causing shaft 162 to operate crank 146 and turn butterfly 142 increasingly clockwise. When the pressure in chamber space 150 is relieved, spring 158 returns movable wall 154, and hence butterfly 142 also, toward the position shown in the Figure. Movable wall 154 is constructed to flex in a manner that allows actuator to impart turning motion to crank 146 without any creating any significant twisting moment in shaft 162. A port 164 in valve body 134 upstream of butterfly 142 communicates exhaust to cooler 36.

How regulator 50 performs regulation will be explained with reference to FIGS. 3 and 5. When EGR is requested, ECU 38 energizes solenoid coil 118. The pressure difference across EGR valve 34 that appears across movable wall 64 of regulator 50 when engine 12 is running and the turbocharger is operating causes the wall 64 to move to the left from the position shown in FIG. 3, compressing spring 98 axially in a like amount, and spring 94 forces stem 80 to follow the movement of wall 64 to assume a position substantially like that in FIG. 5. The stem motion to the left releases valve element 126, allowing spring 128 to move valve element 126 to a position substantially as shown in FIG. 5.

With solenoid coil 118 energized to open passage 108 to chamber space 68, compressed air from source 52 can enter chamber space 68. With the open end of hole 166 at the end of stem 80 spaced slightly from valve element 126, and with the latter sealing chamber space 76 from chamber space 72 to prevent venting of the latter to atmosphere through the former, compressed air from source 52 can build pressure within chamber space 72 because stem 80 provides a continuation of passage 108 to chamber space 72. That increasing pressure is delivered via nipple 70 of regulator 50 and nipple 156 of actuator 132 to actuator chamber space 150. As a result, throttle valve 30 operates to increasingly restrict exhaust gas flow to tailpipe 32.

The increased throttling of the exhaust flow to tailpipe 32 will increase backpressure on the engine and likewise pressure at the inlet of EGR valve 34. But at the same time that pressure increase is being applied to chamber space 58 of regulator 50 via nipple 56. Consequently, wall 64 will commence rightward movement that is imparted to stem 80 as well. When stem 80 has moved sufficiently to make contact with the face of valve element 126 that is toward the stem, that contact occludes the open end of hole 166. Continued displacement of the stem will seal the end of hole 166 closed and begin to unseat valve element 126 from seat 124. The compressed air pressure within chamber space 72 will then commence venting to atmosphere via chamber space 76 and port 74, and the pressure being applied to chamber space 150 of actuator 132 will then begin to decrease. Sufficient clearance is provided between valve element 126 and the wall of its chamber space to allow air to pass through to nipple 74 when the valve element is unseated. This can be done in different ways. One way is by guiding the circular perimeter of the valve element on circumferentially spaced ribs that run lengthwise in the chamber wall so that air can vent through channels between the ribs. Because the end of hole 166 is sealed closed by the stem contact with valve element 126, the pressure loss in chamber space 72 cannot be made up. However, the drop in air pressure to actuator 132 will cause throttle valve 30 to reduce the exhaust gas restriction to tailpipe 32, and hence also reduce the pressure in chamber space 58 because of the communication of exhaust system pressure at the inlet of EGR valve 34 to that chamber space. This will then result in stem 80 moving leftward to once again allow compressed air pressure to build in chamber space 72.

In this way a regulated pressure is established in chamber space 72. The magnitude of the regulated pressure establishes a corresponding operating position of throttle valve 30 for achieving a desired pressure differential across EGR valve 34.

From this description, one can appreciate that the extent to which stem 80 is displaced toward valve element 126 is determined by the position of disk 95, which in turn is a function of the difference between pressure in chamber space 58 and that in chamber space 62. For enabling regulator 50 to maintain a pre-established difference as set by adjustment mechanism 102, stem 80 is positioned such that the regulated air pressure developed in chamber space 72, as applied to actuator 132, is effective to position throttle valve 30 to restrict exhaust gas flow to tailpipe 32 to an extent that creates a pressure at the EGR valve inlet that exceeds the pressure at the EGR valve outlet by the pre-established difference. The regulating mechanism functions to develop regulated pressure for maintaining pressure differential set by adjusting mechanism 102 because of the mutual interaction that is occurring between wall 64, stem 80, and valve element 126. Valve element 126 may be any suitable elastomer, or it may be another material whose face that confronts stem 80 comprises an elastomer so that hole 166 will be sealed when the stem end abuts valve element 126.

That the system achieves regulation is seen by the following analysis of four types of changes. The analysis assumes that the opening of EGR 34 is constant.

If pressure in exhaust manifold 26 increases, that pressure increase is reflected by an increase in pressure in chamber space 58. Movable wall 64 will displace stem 80 to increase the venting of chamber space 72 which will reduce the regulated pressure being applied to actuator 132. Actuator 132 will in turn operate to reduce the tailpipe restriction thereby relieving the pressure increase in the exhaust manifold so that the EGR rate remains substantially unaffected.

If pressure in exhaust manifold 26 decreases, that pressure decrease is reflected by a decrease in pressure in chamber space 58. Movable wall 64 will be re-positioned to allow spring 94 to displace stem 80 away from valve element 126 to reduce the venting of chamber space 72 which will increase the regulated pressure being applied to actuator 132. Actuator 132 will in turn operate to increase the tailpipe restriction thereby compensating for the pressure decrease in the exhaust manifold so that the EGR rate remains substantially unaffected.

If pressure in intake manifold 22 increases, such as when compressor 20 operates to develop boost, the pressure increase is reflected by an increase in pressure in chamber space 62. Movable wall 64 will be re-positioned to allow spring 94 to displace stem 80 away from valve element 126 to reduce the venting of chamber space 72 which will increase the regulated pressure being applied to actuator 132. Actuator 132 will in turn operate to increase the tailpipe restriction thereby increasing the pressure at the inlet of the EGR valve manifold so that the EGR rate remains substantially unaffected.

If pressure in intake manifold 22 decreases, such as when compressor 20 ceases to develop boost, the pressure decrease is reflected by a decrease in pressure in chamber space 62. Movable wall 64 will displace stem 80 to increase the venting of chamber space 72 which will reduce the regulated pressure being applied to actuator 132. Actuator 132 will in turn operate to reduce the tailpipe restriction commensurate with the decrease in intake manifold pressure manifold so that the EGR rate remains substantially unaffected.

A motion detector 170 is associated with movable wall 64. Failure to sense motion of that wall in certain modes of operation may be indicative of a fault that can be signaled by detector 170. A sensor may be associated with throttle valve 30 for supplying a signal 172 to ECU 38 to disclose a possible fault in throttle valve 30.

From the foregoing description, the reader can appreciate that exhaust gas can be recirculated at a controlled flow rate in the presence of boost. Solenoid coil 118 is energized whenever EGR flow is required and de-energized when EGR is not desired. The disclosed control system is self-regulating. The invention can achieve quick termination of EGR when termination is called for. This may be important in enabling a diesel engine to perform properly when being accelerated from idle.

While the foregoing has described a preferred embodiment of the present invention, it is to be appreciated that the inventive principles may be practiced in any form that falls within the scope of the following claims.

What is claimed is:

1. An internal combustion engine that operates with charge air boost and comprises:

an intake system;

an exhaust system comprising a tailpipe;

a throttle valve for selectively restricting exhaust gas flow to the tailpipe;

an exhaust gas recirculation (EGR) system for controlled recirculation of exhaust gas from the exhaust system to the intake system comprising an EGR valve having an inlet port communicated to the exhaust system upstream of the throttle valve and an outlet port communicated to the intake system; and a control for operating the EGR valve and the throttle valve, including a regulator for operating the throttle valve to partially restrict exhaust gas flow to the tailpipe to regulate the difference between pressure at the EGR valve inlet and pressure at the EGR valve outlet to a desired differential that is substantially unaffected by pressure change in the intake system and in the exhaust system.

2. An internal combustion engine as set forth in claim 1 in which the control comprises a processor that processes data to develop one command signal for controlling the EGR valve and that processes data useful in regulating the difference between pressure at the EGR valve inlet and pressure at the EGR valve outlet to a desired differential to develop another command signal for controlling the throttle valve.

3. An internal combustion engine as set forth in claim 2 in which the processor processes data that includes pressure at the EGR valve inlet, pressure at the EGR valve outlet, and EGR valve position.

4. An internal combustion engine as set forth in claim 1 in which the engine comprises a turbocharger having a compressor in the intake system and a turbine in the exhaust system, in which the inlet port of the EGR valve is communicated to the exhaust system downstream of the turbine, and in which the outlet port of the EGR valve is communicated to the intake system downstream of the compressor.

5. An internal combustion engine as set forth in claim 4 including a cooler through which the inlet port of the EGR valve is communicated to the exhaust system.

6. An internal combustion engine as set forth in claim 1 in which the regulator comprises a device that is communicated to a pneumatic power source and that operates to develop a regulated pneumatic pressure that is communicated to a pneumatic actuator for operating the throttle valve.

7. An internal combustion engine as set forth in claim 6 including a valve for closing communication of the device to a pneumatic power source to prevent the regulator from developing regulated pneumatic pressure.

8. A method of exhaust gas recirculation in an internal combustion engine that operates with charge air boost and comprises:

an intake system;

an exhaust system comprising a tailpipe;

a throttle valve for selectively restricting exhaust gas flow to the tailpipe;

an exhaust gas recirculation (EGR) system for controlled recirculation of exhaust gas from the exhaust system to the intake system comprising an EGR valve having an inlet port communicated to the exhaust system upstream of the throttle valve and an outlet port communicated to the intake system;

the method comprising:

controlling the EGR valve and the throttle valve, including operating the throttle valve to partially restrict exhaust flow to the tailpipe in a manner that regulates the difference between pressure at the EGR valve inlet and pressure at the EGR valve outlet to a desired differential that is substantially unaffected by pressure change in the intake system and in the exhaust system.

9. A method as set forth in claim 8 in which the step of controlling the EGR valve and the throttle valve comprises processing data to develop one command signal for controlling the EGR valve and data useful in regulating the difference between pressure at the EGR valve inlet and pressure at the EGR valve outlet to a desired differential to develop another command signal for controlling the throttle valve.

10. A method as set forth in claim 9 in which the processing step includes processing pressure at the EGR valve inlet, pressure at the EGR valve outlet, and EGR valve position.

11. A method as set forth in claim 8 in which the step of operating the throttle valve to partially restrict exhaust flow to the tailpipe in a manner that regulates the difference between pressure at the EGR valve inlet and pressure at the EGR valve outlet to a desired differential that is substantially unaffected by pressure change in the intake system and in the exhaust system comprises communicating a pneumatic regulating mechanism of a pneumatic regulator device to a pneumatic power source, developing a regulated pneumatic pressure, and communicating that regulated pneumatic pressure to a pneumatic actuator for operating the throttle valve.

* * * * *